US005252062A

United States Patent [19]

Groves et al.

[11] Patent Number: 5,252,062

[45] Date of Patent: Oct. 12, 1993

[54] THERMAL PROCESSING FURNACE

[75] Inventors: Robert F. Groves, Fairfax; Lynda L. Eaton, St. Albans; David L. Gardell, Underhill; Paul H. Boileau, Jericho Center, all of Vt.

[73] Assignee: International Business Machines Corporation, Armonk, N.Y.

[21] Appl. No.: 961,290

[22] Filed: Oct. 15, 1992

[51] Int. Cl.[5] ..... F27B 5/04

[52] U.S. Cl. ..... 432/205; 432/2; 432/152; 432/241

[58] Field of Search ..... 432/2, 11, 41, 152, 432/156, 203, 205, 220, 241

[56] References Cited

U.S. PATENT DOCUMENTS

| | | | |
|---|---|---|---|
| 4,738,618 | 4/1988 | Massey et al. | 432/241 |
| 4,943,235 | 7/1990 | Nakao et al. | 432/205 |
| 5,131,842 | 7/1992 | Miyazaki et al. | 432/241 |

*Primary Examiner*—William E. Tapoicai
*Attorney, Agent, or Firm*—Heslin & Rothenberg

[57] ABSTRACT

The subject invention encompasses a thermal processing furnace having an elongated cylindrical processing chamber surrounding a tower assembly capable of receiving one or more articles to be processed. A pedestal assembly supports the tower assembly and contains a quartz door thereon which is axially translatable relative to the processing chamber into an inserted position where the tower assembly is inserted into the processing chamber. A quartz flange located along the perimeter of an opening at the end of the processing chamber contacts the quartz door forming a quartz seal therewith when the pedestal assembly is moved into the inserted position. A scavenger cavity is located at the end of the chamber having the opening therein and is in fluid flow relationship with the contact area between the quartz flange and the quartz door forming a quartz seal. Gas from within the processing chamber which may leak through the quartz seal is captured by the scavenger cavity and evacuated by an evacuation means.

21 Claims, 4 Drawing Sheets

THERMAL PROCESSING FURNACE

TECHNICAL FIELD

This invention relates to semiconductor processing equipment and, more particularly to a thermal processing furnace useable for high temperature processing of semiconductor wafers.

BACKGROUND ART

Thermal processing furnaces are used to provide high temperature processing of semiconductor based wafers which are placed within a gas filled processing chamber. Several silicon, silicon based or other types of wafers typically used in manufacturing semiconductor integrated circuits are placed within the furnace for high temperature thermal processing. To avoid the contact of wafers with human hands, the wafers are mechanically inserted into the furnace. In vertical atmospheric diffusion furnaces the wafers are usually inserted into a tower which is on top of a pedestal assembly. The pedestal assembly vertically transports the tower into a tubular shaped chamber of the furnace where the thermal processing occurs. Using a similar principal, horizontal processing furnaces utilize a cantilever assembly which supports wafers therein. The cantilever assembly is transported along a horizontal axis into a horizontally oriented tubular shaped processing chamber. In either type of furnace, it is desired that the wafers be protected from exposure to undesirable gases to ensure proper thermal processing. For example, oxygen, water vapor and particulates found in air can react with the wafers and adversely effect their chemical and physical properties.

In order to ensure the purity of the reactions the processing chamber of the furnace must be adequately sealed. Therefore, in a vertical thermal processing furnace the interface between the pedestal assembly and processing chamber is designed to prevent reactant gases, from within the processing chamber, from leaking therethrough. Typically, in vertical thermal diffusion furnaces the pedestal assembly is sealed from the tubular processing chamber by an O-ring. Moreover, the tubular processing chamber is usually mounted on a base and is also sealed thereto by an O-ring. One such vertical thermal processing furnace is available from BTU International of North Billerica, Massachusetts.

A problem with using O-rings as seals between the pedestal assembly and processing chamber interface as well as between the processing chamber and base is that O-rings have a tendency to deteriorate when exposed to prolonged high temperatures. Operation of a thermal processing furnace for an extended period of time at processing chamber temperatures greater than 800° C may result in failure of the O-rings. In order to alleviate this problem certain vertical furnaces have been provided with water cooling systems to help cool the O-ring seals and extend their effective life. However, cooling of the pedestal and/or base to a temperature where gases are exposed to temperatures below 130° C may cause hydrochloric acid to condense. The accumulated acid results in a contamination hazard to the wafers, a safety problem for the operator and a maintenance problem for the furnace.

U.S. Patent No. 4,992,044 discloses a reactant exhaust system for a horizontal thermal processing furnace having a scavenger assembly surrounding a collar located at the open end of a tubular processing chamber. A quartz end section having a quartz flange contacts the collar when the processing chamber is closed and a tubular cantilever affixed to the tubular quartz section is inserted into the tubular processing chamber. The scavenger assembly is used to capture exhaust gases by suction therethrough. This configuration, however, utilizes an O-ring type seal for the scavenger assembly which, also, may have a tendency to fail at high temperatures. Moreover, the scavenger assembly must be driven at a high negative pressure or suction in order to effectively remove leaking gases.

DISCLOSURE OF INVENTION

It is therefore an object of the present invention to more effectively seal the opening of the processing chamber during use.

A further object of the present invention is to provide a system for sealing the area between the flange of a tubular processing chamber of a furnace and the door of the pedestal assembly.

A further object of the present invention is to eliminate the need for using water or other fluids to cool the door and processing chamber interface.

A further object of the present invention is to eliminate the use of O-ring seals; including use thereof in an area of the furnace where high temperature may affect the performance of the O-rings.

A further object of the present invention is to provide a system for capturing gases which may leak from within the processing chamber of a furnace and to provide a relatively small temperature gradient at the interface between the door and processing chamber.

A further object of the present invention is to provide a system which results in a more uniform and controllable temperature in the processing chamber.

A further object of the present invention is to maintain temperatures in the region of the leaking gases which is above the point at which Hydrochloric acid gas will condense.

A further object of the invention is to provide a scavenger assembly which functions at low pressure thereby avoiding the necessity of utilizing high suction pressure.

In a broad sense, the invention includes a tubular furnace having a cylindrical processing chamber and a quartz flange located along the perimeter of an opening of a processing chamber which contacts a quartz door when the processing chamber is closed during operation of the oven. The contact area between the quartz flange and the quartz door forms a quartz seal. A scavenger cavity located at the end of the cylindrical processing chamber is in fluid flow relationship with the contact area forming the quartz seal. Gases from within the processing chamber which leak past the quartz seal are capable of being evacuated through the scavenger cavity. A pedestal assembly supports a tower assembly containing the wafers, and is transportable into the processing chamber.

The scavenger cavity surround the quartz door when the pedestal assembly is in an inserted position during operation of the cylindrical processing chamber thereby encircling the contact area between the quartz flange and quartz door. An entry slot may be formed between the quartz flange and an inner wall defining the scavenger cavity. The entry slot may surround the contact area between the quartz door and the quartz flange to allow gas to flow therethrough and into the scavenger cavity.

The scavenger cavity may include a means for causing uniform flow of exhaust gases through the entry slot and the scavenger cavity. The means for casuing uniform flow may include an inner baffle having a length with a mid point thereof located at the same circumferential position within the scavenger cavity as an evacuation outlet of the scavenger cavity. The length of the inner baffle may be approximately one third of the length of the circumference of the scavenger cavity.

The quartz flange may further include a radially outwardly protruding lip having a top and bottom portion. The quartz flange is supported by a support member. A clamping means clamps the quartz flange in place. The support member and quartz flange may define channel member capable of receiving the radially outwardly protruding lip.

A first graphite gasket may be located between the top portion of the outwardly protruding lip and the clamping member. The support member may contain a groove therein capable of receiving a second graphite gasket between the bottom portion of the radially outwardly protruding lip and the support member.

The invention also encompasses a scavenger assembly for a thermal processing furnace having a cylindrical processing chamber and a pedestal section with a quartz door axially movable relative to the processing chamber. The scavenger assembly includes a quartz flange surrounding an opening of the end of the processing chamber, a scavenger cavity surrounding the door being defined by a radially outer wall, inner wall and bottom, a support member contains the scavenger cavity and supports a radially outwardly extending lip portion of the quartz flange, and an entry slot formed between the quartz flange and the radially inner wall of the scavenger cavity surrounding a quartz door contacting the quartz flange when the pedestal assembly is in an inserted position. The entry slot forms an entrance to the scavenger cavity for gases which leak from within the furnace between the quartz door and the quartz flange. These gases are evacuated through the scavenger cavity by an evacuation means attached thereto.

The scavenger cavity surrounds the quartz door when the pedestal assembly is in the inserted position thereby encircling the contact area between the quartz flange and the quartz door. An inner baffle may be located within the scavenger cavity and may have a length with a mid point thereof located at the same circumferential position within the scavenger cavity as an evacuation outlet of the scavenger cavity. The arc length of the inner baffle may be approximately one third the length of the scavenger cavity. The quartz flange may have a radially outwardly protruding lip having a top and bottom portion. A clamping means may be affixed to the support member. The clamping means and support member define a channel capable of receiving the radially outwardly protruding lip of the quartz flange. A graphite gasket may be located between the top portion of the outwardly protruding lip and the clamping member. The support member may contain a groove therein capable of receiving a second graphite gasket which may be located between the bottom portion of the outwardly protruding lip and the support member.

BRIEF DESCRIPTION OF THE DRAWINGS

The foregoing and other objects, features and advantages of the invention will be apparent from the following more particular description of preferred embodiments of the invention as illustrated in the accompanying drawings.

BEST MODE FOR CARRYING OUT THE INVENTION

Figure 1:
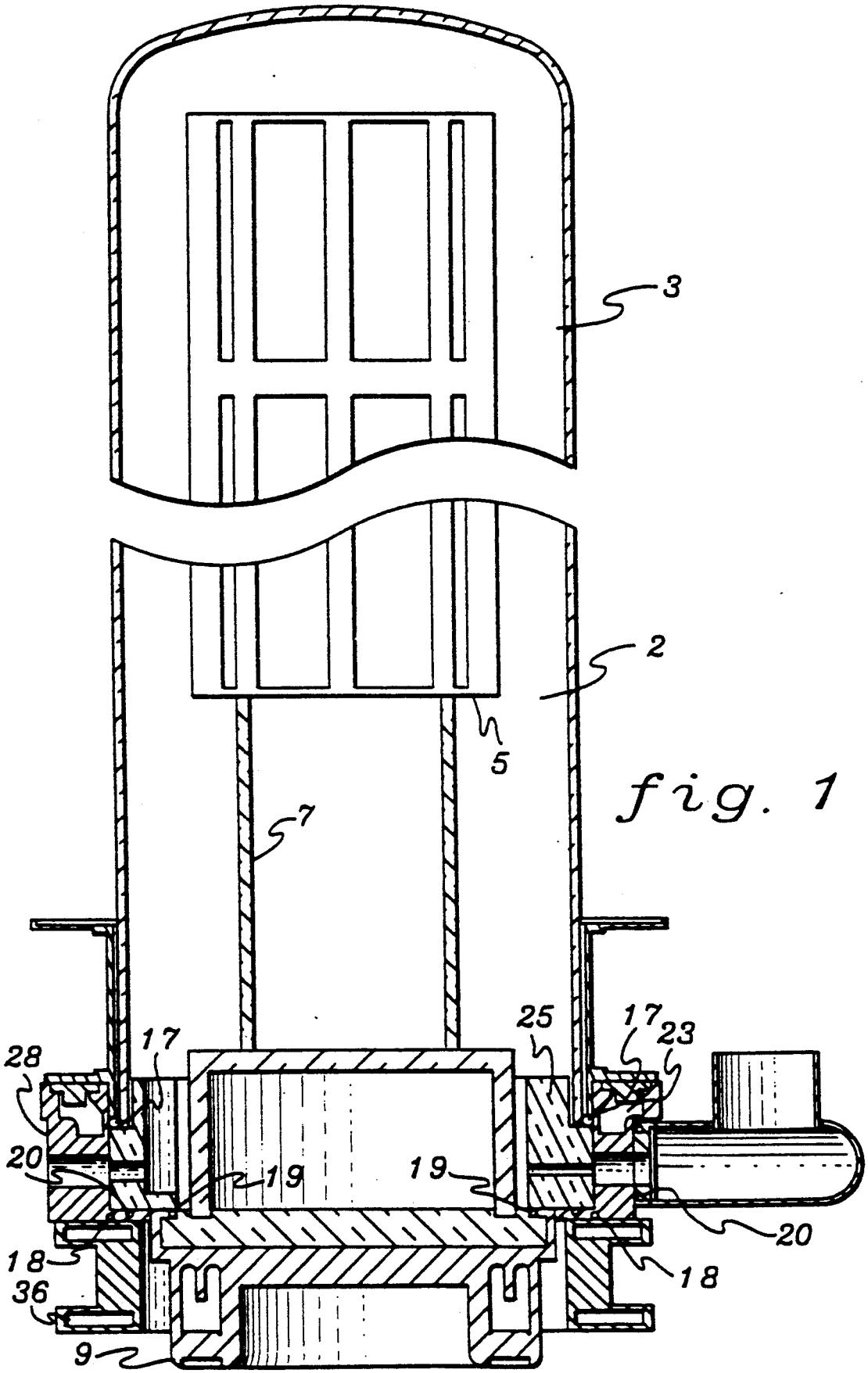
FIG. 1 is a sectional view of a vertical diffusion furnace using conventional O-ring seals between the door of the pedestal assembly and the processing chamber.

As depicted in FIG. 1, the conventional thermal processing furnace 1 includes a cylindrical chamber 3 having an opening at the lower end where a pedestal assembly 9 and strut assembly 7 are located to support a tower assembly 5 which is capable of supporting, for example, silicon wafers for processing within the processing chamber 2. A processing chamber 2 is defined by the cylindrical chamber 3 which is typically constructed of quartz. A base 25 surrounds and supports the lower portion of the cylindrical chamber 3. The base assembly 25 is surrounded by an outer collar 28 and is located above a gate valve 26. The cylindrical chamber 3 is sealed from the base by an Oring 17 which is designed to prevent gases from within the processing chamber 2 from leaking. The pedestal assembly 9 is sealed to the base when the tower assembly is in the inserted position (FIG. 1) by O-ring 19 which also prevents gas from leaking out of the processing chamber. O-ring seals 18 and 20 prevent gas from leaking between the outer collar 28 and gate valve 26, and between the base and outer collar, respectively. O-ring seal 17 has a tendency to deteriorate if exposed to high temperatures for extensive periods of time. Accordingly, a cooling chamber 23 has been used to reduce the temperature of the base 25 and the O-ring 17. However, with the corresponding reduction in temperature at the base, hydrochloric gas from within the processing chamber 2 tends to condense and cause corrosion.

In accordance with the principles of the present invention a thermal processing furnace has been developed which eliminates the use of O-ring seals without the necessity for creating conditions where corrosives such as Hydrochloric acid gas within the processing chamber 2 may condense and cause corrosion.

Figure 2:
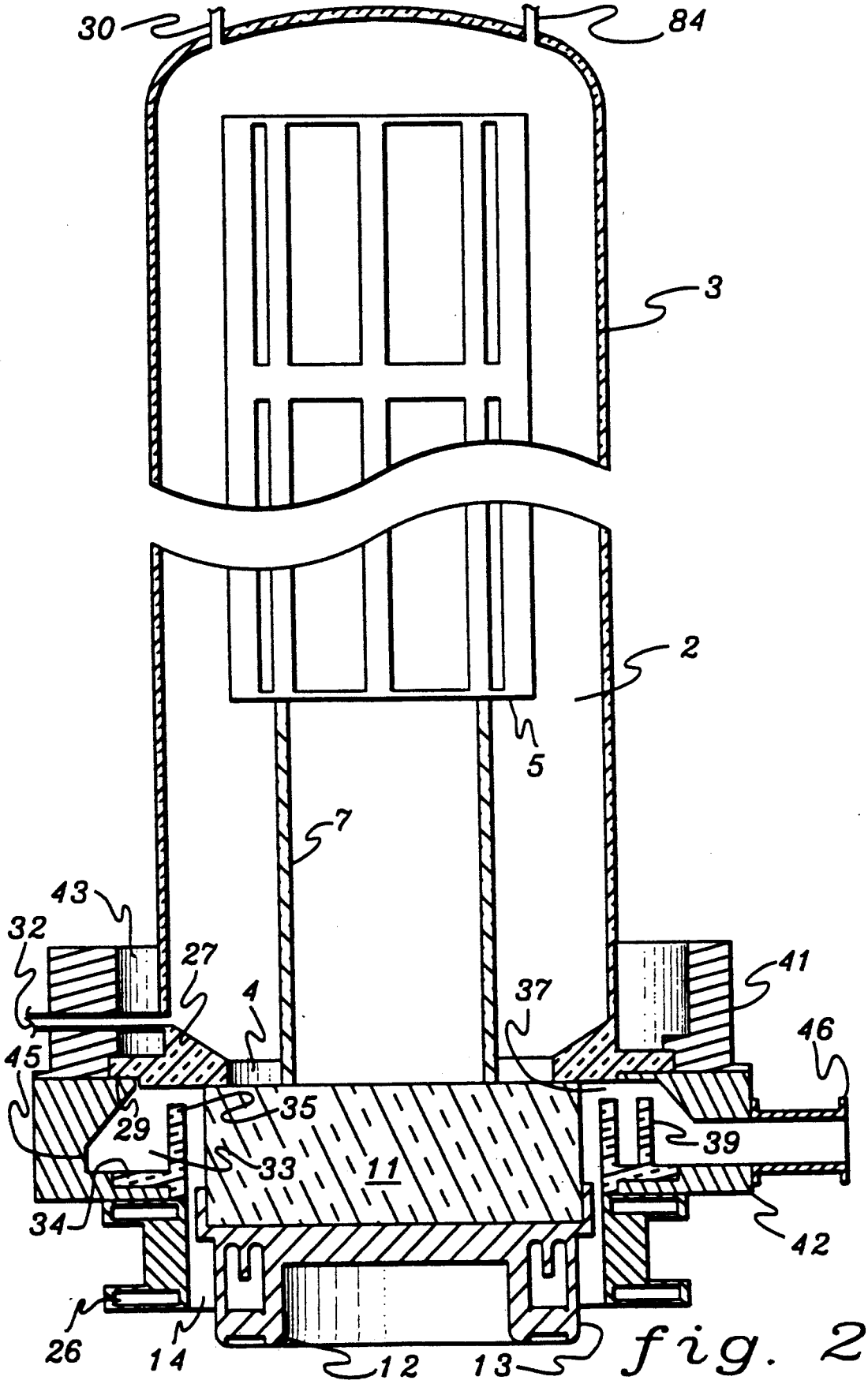
FIG. 2 is a sectional view of a vertical diffusion furnace having a tubular processing chamber and incorporating the principles of the present invention.

FIG. 2 depicts a vertical tubular thermal processing furnace constructed in accordance with the principles of the present invention. Referring to FIG. 2 a processing chamber 2 is defined by an elongated cylindrical chamber 3 having an opening 4 at its lower end. The chamber is preferably constructed of quartz and contains a quartz flange 27 defining and surrounding the opening 4. Flange 27 contains a radially outwardly protruding lip 29 also surrounding the opening 4 of the cylindrical chamber 3. Typically, the cylindrical chamber 3 is tubular in shape having a uniform diameter throughout its length, and the opening 4 is preferably circular in shape. An insulating means 43 is located on top of, and supported by, a radially outward protruding lip 29 of the quartz flange 27. The radially outwardly extending lip 29, of the quartz flange 27 is supported by support member 42 and clamped by clamping member 41. The support member 42 functions to support a scavenger cavity 33 to the cylindrical chamber 3 and radially outwardly extending lip 29 of the quartz flange 27. Also, the clamping member 41 maintains the insulating means 43, which may comprise an insulating bushing or the like, between the clamping member 41 and the cylindrical chamber 3. An inlet 30 allows gases to be input into the processing chamber 2; gases are exhausted through the chamber exhaust 32. A thermocouple inlet 84 allows for the insertion of a profile thermocouple device into the processing chamber 2.

A tower assembly 5 rests on strut assembly 7 which is supported by a pedestal assembly 13. The pedestal assembly 13 includes a quartz door 11 mounted above a pedestal 12. The pedestal assembly 13 translates axially relative to the cylindrical processing chamber 3 thereby translating the tower 5 axially within the processing chamber 2. When the pedestal assembly 13 and tower assembly 5 are in a fully inserted position (as shown in FIG. 2) the quartz door 11 of the pedestal assembly 13 contacts the lower portion of the quartz flange 27. The contact area between the flange 27 and quartz door 11 acts as a seal of the processing chamber 2. A gate valve 26 typically shaped in the form of a collar surrounds the pedestal 12 and is separated therebetween by a gap 14 which may be annular in shape.

In accordance with the principles of the present invention, a scavenger cavity 33 surrounds the quartz door 11 to capture any gases which may leak past the seal formed at the contact area between the quartz flange 27 and the quarts door 11. The scavenger cavity 33 is preferably annular in shape and is formed by a radially inner wall 35 which is integral with a bottom surface 34, which are both preferably constructed of quartz, and a radially outer wall 45 which is integrally formed to the support member 42. An entry slot 37 is formed between the top edge of the radially inner wall 35 and the lower surface of the quartz flange 27. The entry slot 37 surrounds the pedestal assembly 13 near the contact area between the quartz flange 27 and the quartz door 11. The gap 14 between the gate valve 26 and pedestal 12 extends between the radially inner wall 35 and quartz door 11. Therefore, the scavenger cavity 33 is in fluid flow relationship with the gap 14 via the entry slot 37. The gap 14 is in fluid flow relationship with an exhaust gas supply means. The exhaust gas supply means may include a load lock (not shown) which may control the input of gases such as for example, nitrogen into the gap 14. Alternatively, the exhaust gas may be air and the gap 14 may be exposed to ambient air. In either situation, exhaust gases from the gap 14 are suctioned through the scavenger cavity 33 and entry slot 37 by an evacuation means (not shown) attached to the exhaust port 46. Any gases from within the process chamber 2 which may leak past the quartz seal at the contact area between the quartz flange 27 and quartz door 11 will be suctioned through the entry slot 37 and scavenger cavity 33, along with the exhaust gases, and eventually through the exhaust port 46.

The exhaust port 46 may be integrally formed to the support member 42 and is in fluid flow relationship with the scavenger cavity 33. Gases collected within the scavenger cavity 33, and exhausted through the exhaust port 46 are suctioned by a suction means (not shown) which creates an exhaust velocity of gases through the entry slot 37 for removing exhaust gases from the scavenger cavity 33.

Figure 4:
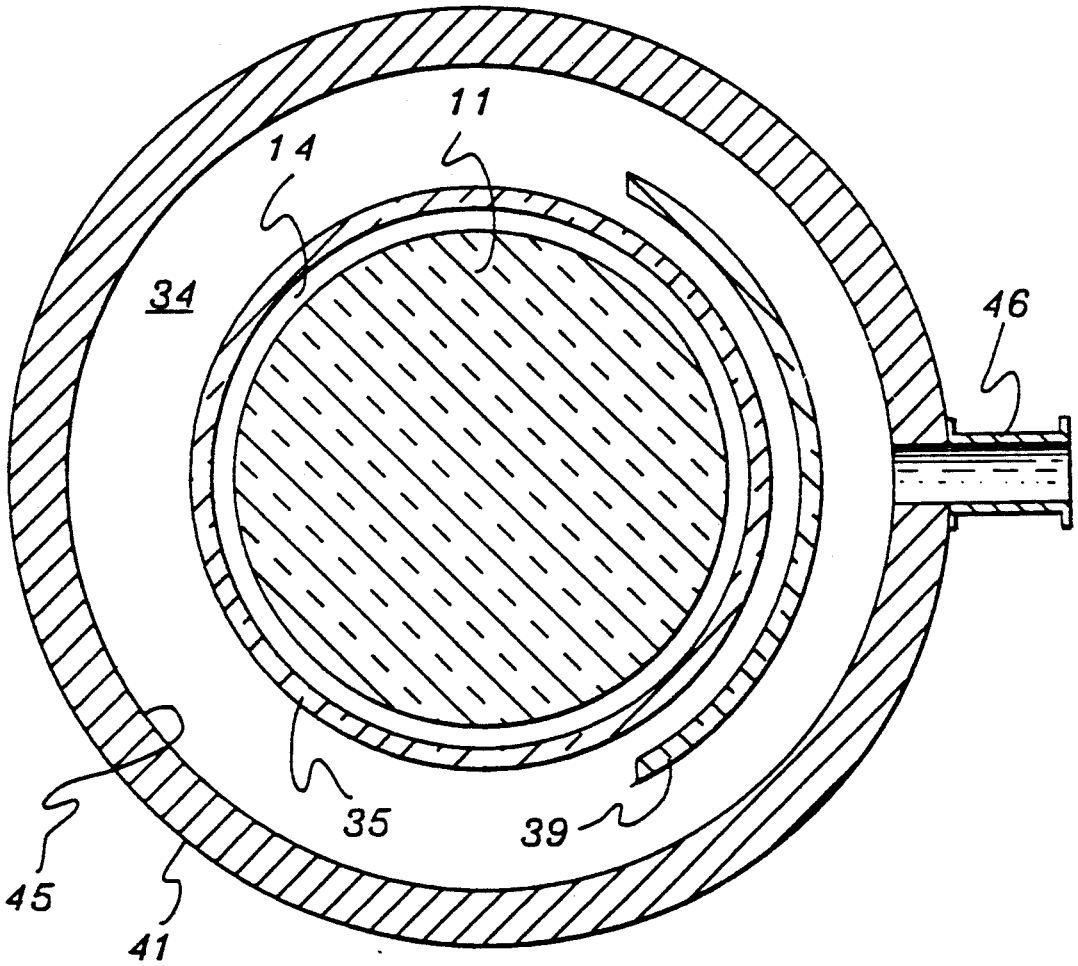
FIG. 4 is a sectional view along line 4—4 of FIG. 3.

An inner baffle 39, shown in FIG. 4, formed by a vertically extending wall, is located within the scavenger cavity 33. The inner baffle 39 oriented within the scavenger cavity facilitates a uniform exhaust capture velocity through the entry slot 37 about the entire circumferential length of the entry slot. The inner baffle should preferably extend 120° such that the length of the inner baffle 39 is about one third of the length of the circumference of the scavenger cavity 33. However, baffles of less than, or greater than, 120° may also be used and the invention is not limited to any particular baffle length. The inner baffle 39 is centered at the section of the scavenger cavity having the exhaust port 46. Preferably, the mid-point of the length of the inner baffle 39 should be located at the same circumferential position as the scavenger cavity exhaust port. By sizing inner baffle 39 so that its arc length is about 120° and so that its midpoint is located at the exhaust port 46, a condition is created in which the exhaust capture velocity through the entry slot 37 is substantially uniform, as measured at any point about the circumference of the entry slot. In order to ensure proper evacuation of exhaust gas through the scavenger cavity 33, the velocity of exhaust gases through the entry slot 37 should be greater than 70 linear feet per minute. It has been found that exhaust velocities less than 70 linear feet per minute may not allow for adequate evacuation of exhaust gases. It is preferable, however, that the exhaust capture velocity be greater than 90 linear feet per minute.

Various size scavenger cavities may be used in a furnace in accordance with the principles of the present invention. Different size scavenger cavities will require different volumetric flow rates of exhaust gases flowing therethrough in order to achieve the preferred minimum exhaust velocity of 90 linear feet per minute. For example, a scavenger cavity 33 having a relatively larger capacity will require a higher volumetric evacuation flow rate of exhaust gases therethrough than the volumetric flow rate of exhaust gas flowing through a smaller capacity scavenger cavity in order to achieve the same linear velocity of the exhaust gases flowing through the entry slot 37. Also the scavenger cavity should be sized with regard to the exhaust evacuation source with which the scavenger cavity will be coupled.

Figure 3:
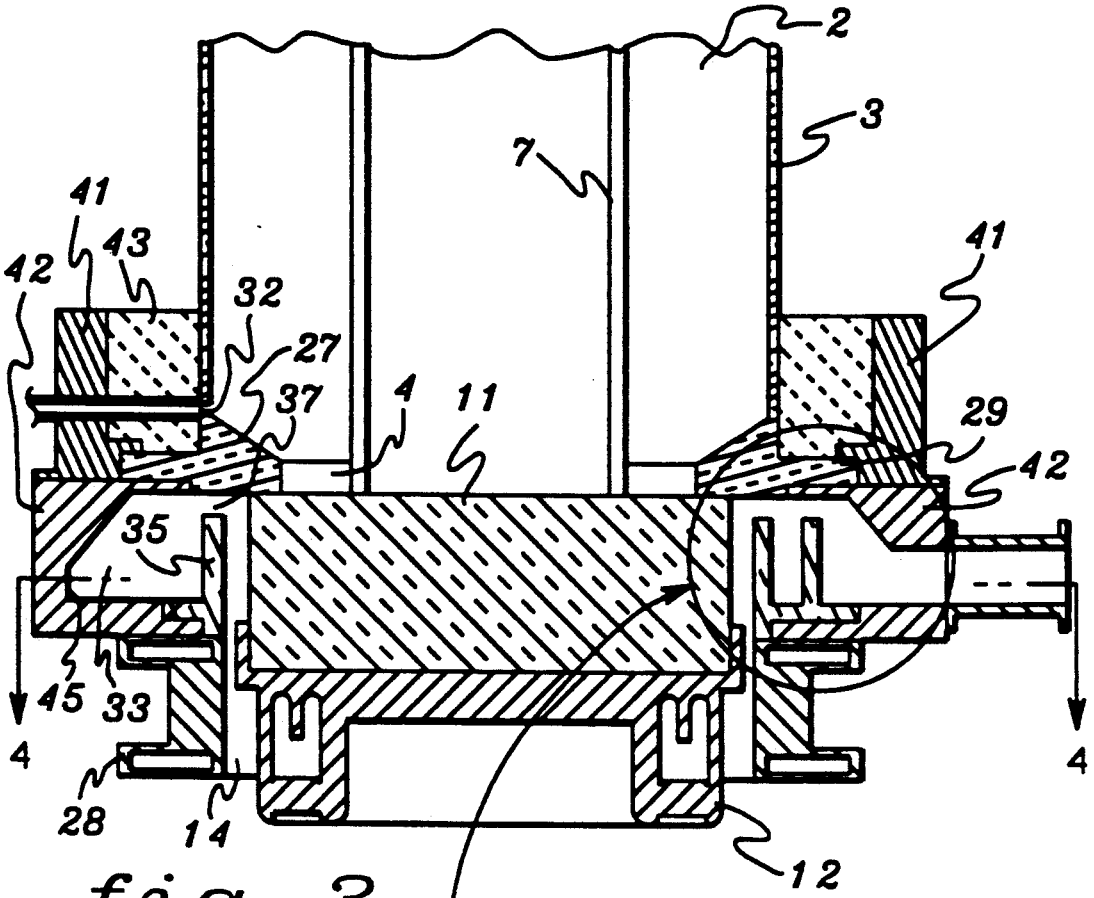
FIG. 3 is a partial sectional view of the open end of a tubular processing chamber of the vertical diffusion furnace, pedestal assembly and scavenger cavity in accordance with the principles of the present invention.
Figure 3A:
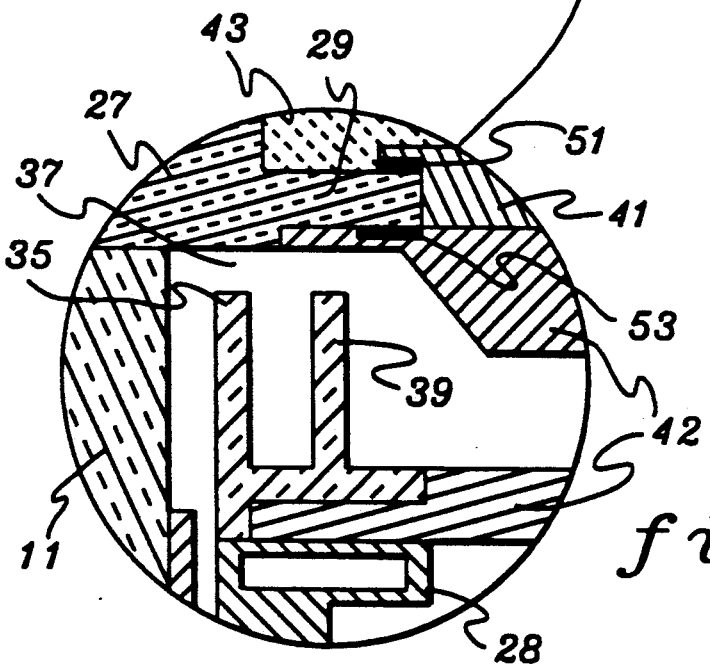
FIG. 3*a* is an exploded detailed view of a section of the diffusion furnace depicted in FIG. 3.

Referring to FIG. 3 and 3*a*, the entry slot 37 may be located within ¼ of an inch from the quartz door 11. Also, the entry slot 37 may be between ⅛ to 1/16 of an inch wide, as defined from the underside of the quartz flange 27 to the top of the inner wall 35. The configuration of the scavenger cavity as shown in FIG. 3*a* and FIG. 4 creates, throughout the entire length of the entry slot 37, a substantially uniform exhaust gas velocity through the entry slot 37 from the gap 14 when a suction or evacuation means (not shown) connected to the exhaust port 46 is activated. This configuration enables the desired exhaust velocity to be achieved while the scavenger cavity is being driven at a relatively low suction pressure by the evacuation means. The entry slot 37 is sized to ensure a desired minimum exhaust gas velocity, preferably 90 linear feet per minute.

Referring to FIG. 3*a*, the radially outwardly protruding lip 29 of the flange 27 is supported by support member 42 and clamped by clamping member 41. Clamping member 41 and support member 42 form a channel which is capable of receiving radially outwardly protruding lip 29. Since the flange 27 is made of quartz and the clamping member is preferably made of a metal or metal alloy, graphite gaskets 51 and 53 may be used to prevent the metal clamping member 41 and support member 42 from contacting the quartz lip 29 and causing the quartz lip 29 to crack. The first graphite gasket 51 is located between the clamping member 41 and a top portion of the radially outwardly protruding lip 29. The second graphite gasket 53 is located within a grove, between the bottom of the radially outwardly protruding lip 29 and the top of the support member 42.

The insulating means 43 located between the cylindrical chamber 3 and the clamping member 41 may be constructed of an alumina-silicon insulating material or the like. The cylindrical chamber 3, flange 27, and door 11 of the pedestal assembly 13 are made of quartz. Also, the radially inner wall 35, inner baffle 39 and bottom portion 65 lining the scavenger cavity 33 are preferably quartz.

During the operation of the vertical processing furnace the pedestal assembly 13 is in the inserted position, as shown in FIG. 2, and the flange 27 is in contact with the quartz door 11. Gases within the processing chamber 2 which may escape between the flange 27 and quartz door 11 will be suctioned through the entry slot 37 encircling the lower end of the cylindrical chamber 3 and quartz door 11. The gases will be captured by support air or gas flowing within the gap 14 and will flow into the entry slot 37. The gases will enter the scavenger cavity 33 and be exhausted by a suction means (not shown) engaging the exhaust port 46. The scavenger cavity configuration depicted in FIGS. 3, 3*a* and 4 creates an exhaust gas velocity throughout the length of the entry slot which is substantially uniform throughout the length of the entry slot. Moreover, this configuration constructed in accordance with the principles of the present invention provides for a more stable temperature at the interface between the quartz door 11 and quartz flange 27.

The scavenger cavity configuration depicted herein and constructed in accordance with the principles of the present invention may be incorporated into various diffusion furnace configurations not depicted herein. Therefore, while the invention has been particularly shown and described with reference to preferred embodiments thereof, it will be understood by those skilled in the art that various changes in form and detail may be made therein without departing from the spirit and scope of the invention.

What is claimed is:

1. A thermal processing furnace comprising:

an elongated cylindrical processing chamber for surrounding a tower assembly capable of receiving one or more articles to be processed, said cylindrical processing chamber having an opening at one end thereof;

a quartz door operatively engaged to the tower assembly thereon and being axially transportable relative to the processing chamber into an inserted position wherein the tower assembly is inserted into the processing chamber;

a quartz flange located along the perimeter of the opening of the processing chamber wherein the quartz flange contacts the quartz door when the quartz door is translated into the inserted position thereby forming a quartz seal; and a scavenger cavity located at the end of the chamber having said opening, the scavenger cavity being defined by an inner wall, said inner wall and quartz flange forming an entry slot therebetween, the entry slot leading into the scavenger cavity and being in fluid flow relationship with a contact area between the quartz flange and quartz door forming the quartz seal wherein gases from within the processing chamber which leak past the quartz seal are capable of being evacuated into the entry slot and through the scavenger cavity.

2. The furnace of claim 1 wherein the scavenger cavity surrounds the quartz door when the tower assembly is in the inserted position thereby encircling the contact area between the quartz flange and quartz door.

3. The furnace of claim 1 wherein the entry slot surrounds the contact area between the quartz flange and quartz door.

4. The furnace of claim 3 further comprising a gap located between the inner wall and the quartz door, the gap being in fluid flow relationship with an exhaust gas supply means and the entry slot.

5. The furnace of claim 4 further comprising an inner baffle within said scavenger cavity, said inner baffle having a length with a mid-point thereof located at the same circumferential positional within the scavenger cavity as an evacuation outlet of the scavenger cavity.

6. The furnace of claim 4 wherein the length of the inner baffle is approximately one third of the length of the circumference of the scavenger cavity.

7. The furnace of claim 6 wherein the quartz flange further comprises a radially outwardly protruding lip having a top and bottom portion.

8. The furnace of claim 7 further comprising a support member containing said scavenger cavity, said support member supporting said radially outwardly protruding lip.

9. The furnace of claim 7 wherein the clamping member contains a first graphite gasket between a bottom section of the clamping member and the top of said outwardly protruding lip.

10. The furnace of claim 7 further comprising a second graphite gasket located within a groove, between the bottom of the radially outwardly protruding lip and the top of said support member.

11. A thermal processing furnace comprising:

an elongated cylindrical processing chamber for surrounding a tower assembly capable of receiving one or more articles to be processed, said cylindrical processing chamber having an opening at one end thereof;

a quartz door operatively engaged to the tower assembly and being axially transportable relative to the processing chamber into an inserted position wherein the tower assembly is inserted into the processing chamber;

a quartz flange located along the perimeter of the opening of the processing chamber wherein the quartz flange is positioned to make contact with the quartz door at a contact region when the quartz door is translated into the inserted position thereby forming a quartz seal;

a scavenger ring including (a) a cavity surrounding the contact region, (b) an opening through which gases may be evacuated from the cavity, and (c) means for ensuring gases leaking from said process chamber past said contact region are drawn into the cavity with a substantially uniform flow velocity about the entire radially outer periphery of said contact region when the opening is coupled to an evacuation source.

12. A thermal processing furnace of claim 11 wherein the means for ensuring comprises a baffle positioned in the cavity.

13. A scavenger assembly for a furnace having a cylindrical processing chamber and a pedestal section with a quartz door being axially moveable relative to the chamber, said scavenger assembly comprising:

a quartz flange surrounding an opening of the end of the chamber, the quartz door contacting the quartz flange when the pedestal assembly is in an inserted position;

a scavenger cavity surrounding the door defined by a radial outer wall, an inner wall and a bottom;

a support member containing the scavenger cavity, said support member supporting a radially outwardly extending lip portion of the quartz flange therein;

an entry slot formed between the quartz flange and the radially inner wall of the scavenger cavity surrounding the door, said entry slot forming an entrance to the scavenger cavity for gases which leak from within said furnace between the quartz door and quartz flange.

14. The scavenger assembly of claim 13, wherein the scavenger cavity surrounds the quartz door when the pedestal assembly is in the inserted position thereby encircling a contact area between the quartz flange and quartz door.

15. The scavenger chamber assembly of claim 14 further comprising an inner baffle within said scavenger cavity, said inner baffle having a length with a midpoint thereof located at the same circumferential position within the scavenger cavity as an evacuation outlet of the scavenger cavity.

16. The scavenger assembly of claim 15 wherein the arc length of the inner baffle is approximately one third of the scavenger cavity length.

17. The scavenger assembly of claim 16 wherein the radially outwardly protruding lip of the quartz flange has a top and bottom portion.

18. The scavenger assembly of claim 17, further comprising a clamping means affixed to said support member, said clamping means and support member forming a channel capable of receiving said outwardly protruding lip.

19. The scavenger assembly of claim 17, further comprising a graphite gasket located between the top portion of the outwardly protruding lip and the clamping member.

20. The scavenger assembly of claim 19 wherein the support member contains a groove therein capable of receiving a second graphite gasket therein.

21. The scavenger chamber of claim 20 further comprising a second graphite gasket within said groove, second graphite gasket being between the bottom portion of the outwardly protruding lip and the support member.

* * * * *